United States Patent [19]

Hubbard et al.

[11] 4,090,787

[45] May 23, 1978

[54] AUTOMATIC COPIER MODE CONTROLS

[75] Inventors: James Henry Hubbard, Boulder; Ralph Joseph Leclere, Longmont; Thomas Travis Underhill, Boulder, all of Colo.

[73] Assignee: International Business Machines Corporation, Armonk, N.Y.

[21] Appl. No.: 661,233

[22] Filed: Feb. 25, 1976

[51] Int. Cl.[2] ..... G03G 21/00

[52] U.S. Cl. ..... 355/14

[58] Field of Search ..... 355/14, 23, 24, 26

[56] References Cited

U.S. PATENT DOCUMENTS

| | | | |
|---|---|---|---|
| 3,848,995 | 11/1974 | Gavronski | 355/14 |
| 3,944,360 | 3/1976 | Deetz et al. | 355/14 |

OTHER PUBLICATIONS

Xerox 4500 Copier Operator's Manual, p. 22, 1973.

3M "VHS-R", Copier Operator's Guide.

*Primary Examiner*—A. D. Pellinen

*Attorney, Agent, or Firm*—Herbert F. Somermeyer

[57] ABSTRACT

A multi-mode document reproduction machine (copier) includes automatic reselection, activated when a time-out timer times out, which reselects machine parameters to a dominant copy mode. A dominant mode is that machine mode used in the most number of copy jobs, irrespective of the number of copies made in any of the modes. An intermediate machine state inhibits the time-out timer. Copies in an interim storage unit and a copy jam are two examples that generate an intermediate machine state. Removal of copies or the jam allows the timer to time out.

18 Claims, 5 Drawing Figures

AUTOMATIC COPIER MODE CONTROLS

BACKGROUND OF THE INVENTION

The present invention relates to operational controls for document reproduction machines, particularly to those document reproduction machines having a dominant copy production mode with a plurality of other selectable copy production modes.

Transfer electrographic and other forms of document reproduction machines have been used for years as convenience copiers, as well as in higher throughput copy production applications, such as found in printing or publication centers with the trend to electronic controls of such machines, greater flexibility in automatically controlling these machines has been found economically feasible. The interaction of electronic circuits including programmed processors. With the document reproduction procesor, such as a transfer electrographic processor, can provide enhanced operator conveniences.

A document reproduction machine particularly of the convenience copier type finds diverse usage. That is, a convenience copier having a collator with duplex copying capability (images are impressed on both sides of the copy paper) as well as simplex copying (image on one side of the copy paper). Non-collating functions tend to be used in patterns in accordance with the environmental operational requirements. Many convenience copiers are in an office type environment. In offices, the most common type of copy job is to copy a single sheet of paper on one side. This is not to say that the total number of copies produced on such a document reproduction machine is greater in a single original single copy mode, but that the number of times the copier is used, i.e., the number of jobs in such mode, is the greatest number. For example, if a 50 page document were to be reproduced and automatically collated into 20 copies, a relatively large number of copies are made. However, the number of copy jobs of this type in an office may be limited. When such a special type of job is being performed on the convenience copier, the user attitude is to correctly perform the copy job. Therefore, the attention of the user is focused on the operator selections available to the user for ensuring a successful copy job. On the other hand, in the dominant copy mode, single copy single original, the average user will be impatient with the machine and tend to quickly insert the original into the convenience copier and expect a single copy without further adieu. In other words, the user in the dominant mode is focusing attention on an office procedure other than copy production. With such an interrelationship between a user and a convenience copier, the copy run is error prone. That is, since the operator is not focusing appropriate attention to the convenience copier, more than a single copy is likely to be made if the previous user had used the machine in a non-dominant mode. Such proneness to error is not suitably accommodated by user training, in that many convenience copiers are used by casual users who have no real interest in the copier as a machine. Errors in such simple dominant reproduction modes create unnecessary expense to the user, as well as irritation to the casual user — and possibly embarrassment.

In relatively primitive convenience copier machines, i.e., machines having but one or two modes of copy production, the problems stated above still exist, but with lesser intensity. In those convenience copiers having a plurality of modes involving complex copy jobs, the above stated problem can become more acute.

Some convenience copiers, in the past, included a mode selection portion in an operators console termed "special features." Such mode selection would include selection of an alternate source of paper, two-sided copying, and a selection for a light original document. After a time-out of approximately 50 seconds, after completing a single copy run, irrespective of the copier state, such selections would be automatically reset to normal original, normal paper tray and single sided copying. The number of copies selected to be produced would remain to be adjusted by the next user.

Another copier having a so-called reduction feature, included a time-out circuit responsive to the completion of a copy run to return the number of copies selected to be made to unity, and adjusting the mode of operation of the machine from a reduction to a non-reduction mode. Both of the above referenced machines operated on the basis of a copy run, irrespective of copy jobs. The time-out was subject to interruption upon initiation of a new copy run.

For avoiding errors of copy production caused by error-prone casual users, further controls are necessary for ensuring that the convenience copier performs the functions desired by such a casual user without any emphasis by the user on mode selection of the convenience copier.

SUMMARY OF THE INVENTION

It is an object of the invention to provide a document reproduction machine having automatic controls which reselect the machine features to a dominant state for reducing casual user copy production errors.

In accordance with the invention, a document reproduction machine operable in a succession of copy runs, including a multi-run copy job has a control element for initiating a copy run and imposing one or more of a plurality of copy modes on the machines. One of the modes is a dominant copy mode.

Control means in the document reproduction machine indicate machine states during operation of the machine. Such machine states include states during a copy job and when no copy run is being executed. Status means within the control means indicate a predetermined intermediate one of the machine states to initiate a time-out timer which times a predetermined time-out period. Reselection means are responsive to the time-out timer to reselect the machine modes to said dominant mode. Further, reselect control means are responsive to the run means and the absence of the indicated intermediate state for actuating the time-out timer to time the predetermined period for actuating the reset means.

In one aspect of the invention, the status means indicates an intermediate error recovery state. A paper jam is an error which may require manual intervention for recovery. To recover from such a jam, the covers or doors to the machine have to be opened by the operator. Upon completion of the jam recovery and before the door is closed, the machine is in an intermediate error recovery state. During such state, the machine cannot be started until the unusual condition of an open door has been rectified. Upon closing the door, the intermediate state indication is removed, allowing the timer to be initiated.

In another aspect of the invention, one of the modes is a duplex mode for imposing images on both sides of copy paper. Each copy is subjected to two successive copy runs, one run for each image. In the event of an odd number of copy originals, the last copy will have but one image. In one aspect of the invention, the control means which may include manual actuation by an operator, signifies to the document reproduction machine that the copy job has been completed. Accordingly, in certain aspects of the invention, a second intermediate state occurs on completion of the copy run imposing the first image on a copy sheet. The intermediate state is removed by removing the machine from the duplex mode, or by otherwise signifying to the machine that the copy job has been completed. Such other means may include automatic means, particularly where the original documents are automatically handled by an original document handler. Alternatively, the intermediate states may be timed by a timer.

Other modifications of the invention include adaptively defining the dominant operational mode in accordance with the application of a particular machine.

THE DRAWING

DETAILED DESCRIPTION

Figure 1:
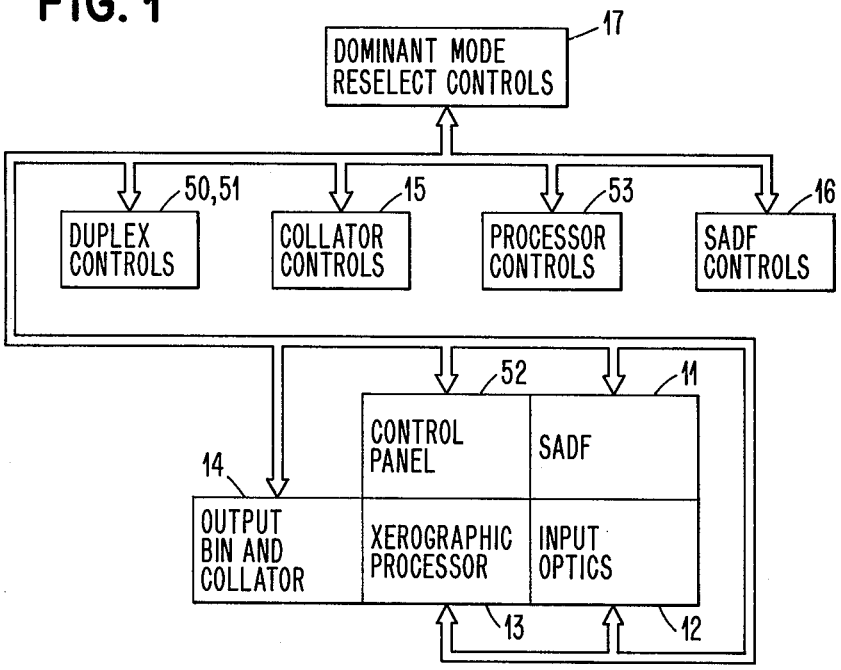
FIG. 1 is a block diagram of a document reproduction machine employing the present invention.

Referring now more particularly to the drawing like numerals indicate like parts and structural features in the various diagrams. The present invention adds dominant mode reselect controls 17 to document reproduction machine 10. A plurality of control circuits, duplex controls 50, 51, collator controls 15, processor controls 53, and SADF controls 16 operate machine 10 as will become apparent in sufficient detail for an understanding of the invention. Details of circuits and portions of machine 10 not necessary for practicing the invention are omitted for brevity.

Document reproduction machine 10 has a semiautomatic document feed (SADF) 11 for transporting originals past an original input optic portion 12. The SADF 11 has a platen (not shown) scanned by optics (not shown) within portion 12 for transferring images of the original documents to document reproduction portion 13 of the document reproduction machine. The images transmitted to portion 13 are impressed upon copy paper and supplied as copies to output copy handler 14, which may be a bin, collator, and the like. The illustrated machine 10 is capable of operating in one or more of a plurality of copy production modes, as will be later described. The most copy jobs in the illustrated machine are the production of one copy from one original document — the dominant mode of the illustrated machine.

When operating in a duplex mode an image is impressed on both sides of the copy paper, portion 13 operates in a succession of paired single-image copy runs. A first run in each pair puts an image on a first side of the copy paper, a second run puts an image on the second side. Each single-image run consists of a plurality of copy production cycles, each cycle represented by the passage of an image area on photoconductor transfer member 20 past image-receiving area 22 which receives the image to be reproduced from portion 12, as indicated by dashed line arrow 23. During each single-image run, the operator controls of the document reproduction machine, except for the stop button, are disengaged. At the end of a single-image run, i.e., the transfer of one image to a plurality of copies, operator selections are enabled. Also, insertion of an original document into SADF 11 causes it to be automatically transferred to the platen (not shown) for being scanned by original input optics 12.

Before proceeding further with the description of the invention, the operation of document reproduction portion 13 is described as a constructed embodiment of a so-called xerographic document reproduction machine. The photoconductor member 20 rotates in the direction of the arrow past a plurality of xerographic processing stations. The first station in xerographic reproduction process is charging station 21 which imposes either a positive or negative electrostatic charge on the surface of photoconductor member 20. It is preferred that this charge be a uniform electrostatic charge over a uniform photoconductor surface. Such charging is done in the absence of light such that projected images, indicated by dash line arrow 23, alter the electrostatic charge on the photoconductor member in preparation for image developing and transferring. Exposure in area 22 exposes the photoconductor surface which was charged to a bright light by the image projected by original input optics 12. Light reflected from the original document discharges the areas on the photoconductor surface in accordance with lightness. With minimal light reflected from the dark or printed areas of the original document, there is no corresponding discharge. As a result, an electrostatic charge remains in those areas of the photoconductive surface corresponding to the dark or printed areas of the original document in SADF 11. This charge pattern is termed a "latent" image on the photoconductive surface. Interimage erase lamp 30E discharges photoconductor member 20 outside defined image areas.

The next xerographic station is the developer 24 which receives toner (ink) laden beads from toner supply 25 for being deposited on the photoconductive surface having charged areas. The developer station receives the toner with an electrostatic charge of polarity opposite to that of the charged areas of the photoconductive surface. Accordingly, the toner particles adhere electrostatically to the charged areas, but do not adhere to the discharged areas. Hence, the photoconductive surface, after leaving station 24, has a toned image corresponding to the dark and light areas of the original documents of SADF 11.

Next, the latent image is transferred to copy paper in transfer station 26. The paper is brought to the station 26 from an input paper path portion 27 via synchronizing input gate 28, thence through transfer station 26 and, finally, along paper path 29. The copy paper is brought into contact with the toned image on the photoconductive surface resulting in a transfer of the toner to the copy paper. After such transfer, the sheet of copy paper is stripped from the photoconductive surface for transport along path 29. Next, the paper has the image fused thereon in fusing station 31 creating a permanent image on the copy paper. Such copy paper receives electrostatic charges which have an adverse affect on copy handling. Accordingly, the copy paper after fusing is electrically discharged at station 32 before transfer to output portions, as later described.

Returning now to the photoconductor member 20, after the image area leaves transfer station 26, there is a certain amount of residual toner on the photoconductive surface. Accordingly, cleaner station 30 has a rotating cleaning brush to remove the residual toner for cleaning the image area in preparation for receiving the next image projected by original input optics 12. The cycle then repeats by charging the just-cleaned image area by charging station 21.

The production of simplex copies or the first side of duplexing copies by portion 13 includes transferring a blank sheet of paper from blank paper supply 35, thence to transfer station 26, fuser 31, and, when in the simplex mode, directly to the output copy handler 14. When handler 14 consists of a copy receiving tray (not shown), aligner 37 may be dispensed with. Blank paper supply 35 has an empty sensing switch 36 which inhibits operation of portion 13 in a known manner whenever supply 35 is out of paper.

When in the duplex mode, duplex diversion gate 42 is actuated by the duplex controlling circuits 50 to the upward position for deflecting single-image copies to travel over path 43 to the interim storage unit 40. Here, the partially produced duplex copies (image on one side only) reside waiting for the next subsequent single-image run of the pair in which the copies receive the second image. In the next-successive single-image run, initiated by inserting a document into SADF 11, the copies are removed one at a time from the interim storage unit 40, transported over path 44, thence to path 27 for receiving a second image, as previously described. The two-imaged duplex copies are then transferred into output copy handler 14. For purposes of the present invention, a switch 41 of interim storage unit 40 detects whether or not there are any copies or paper in interim storage unit 40. If so, an activating signal is supplied over line 45 to duplex control circuits 50 and to duplex job terminating circuits 51. Circuits 51, as will be described, cause the automatic transfer of the single image duplex copies from interim storage unit 40 through paths 27 and 29, thence to the output copy handler 14 without receiving an image in transfer station 26. This action is a preparatory step for ensuing copy production runs.

The document reproduction machine has a control element panel 52 having a plurality of lights and switches (most not shown), as well as a set of other control circuits 53 which operate the entire machine synchronously with respect to the movement of the image areas of photoconductor member 20. Billing meter M of circuits 53 counts images processed for billing purposes. For example, paper release gate 28 is actuated synchronously with the image areas moving past developer station 24. Such controls are well known in the art and are not described here for purposes of brevity.

Operation of duplex control circuits 50 is initiated by duplex mode selecting switch 55 supplying ground reference potential to noise-rejecting type of pulse-forming circuit 56. Circuit 56 may be inhibited during a single-image run by a signal received over line 57 from other control circuits 53. Pulse former circuit 56 supplies its output pulse indicating the switch 55 has been actuated to trigger select duplex trigger 60 to its opposite state. Accordingly, each closure of switch 55 switches the document reproduction machine between simplex and duplex modes. That is, trigger 60 being set to a first state indicates the duplex reproduction mode; and being reset to a second state indicates a simplex reproduction mode. The duplex reproduction mode is indicated by an active signal traveling over line 61, to AND circuits 62 and 63. AND circuit 62 responds to the duplex mode signal on line 61, to a side latch $=1$ signal from latch 64, and to a blank sheet picked signal from switch 70 on line 65 to actuate duplex gate latch 66 to the set state.

When in the duplex mode, duplex gate latch 66 is in the active condition. The latch 66 supplies its active signal through amplifier-driver 72 for actuating solenoid 73 which pulls gate 42 to the upward position. In the upward position, gate 42 deflects the copies received from path 29 to path 43 as previously described. Gate 42 is alternately actuated for first directing copies to interim storage unit 40 (first single-image run) and then to output aligner 37 (second single-image run) for transmittal to output copier handler 14. The alternating action is achieved through side latch 64 which supplies the side-1 indicating signal over line 73A and side-2 indicating signal over line 74 to AND circuits 62 and 71, respectively. Side latch 64 is actuated between the set and reset states (side-2 and side-1, respectively) by AND circuits 63, 75. Side-1 is indicated by AND circuit 75 responding to copy path circuits 76 indicating that the copy path is clear. That is, paths 27, 29, and the indicated dash line to output copy handler 14 have no copies. The relationship of copy path circuits 76 to the actual copy path is well known and not shown for purposes of brevity. When the path is clear, circuits 76 supply an active signal over line 77 to both AND circuits 63 and 75. Hence, successive single-image runs in the illustrated copier are nonoverlapping, no limitation thereto intended.

Intermediate the single-image runs, side latch 64 can be switched from 1 to 2 and reversed. In this regard, switch 41 sensing that copies are in interim storage unit 40 supplies its activating signal over line 45. If there are no copies in unit 40, NOT circuit 80 supplies an activating signal through AND circuit 75 resetting side latch to copy side-1. That is, in the duplex mode, the interim storage unit has been emptied and the next copy to be made will be first image on side-1. Similarly, the line 45 signal activates AND circuit 63 to set latch 64 to side-2 state only when select duplex trigger 60 is in the duplex mode. Accordingly, if paper is being temporarily stored in unit 40 and the document reproduction machine is operating in the simplex mode, side latch 64 remains reset to the side-1 indicating state.

At the end of a duplex job, duplex switch 55 is closed for taking the document reproduction machine 10 out of the duplex mode. This action actuates pulse former 56 to supply a pulse triggering duplex trigger 60 to the simplex mode indicating state. The pulse from former 56 also travels to the circuits 51 for emptying the interim storage unit 40 in the event an odd number of images were to be reproduced in the duplex mode. The line 82 pulse samples AND circuit 83; and if there are copies in interim storage unit 40 as indicated by switch 41 being closed, AND circuit 83 sets empty interim latch 84 to the active condition. This active condition actuates circuits for emptying interim storage unit 40. The active signal from latch 84 goes over line 85, then through OR circuit 86 for passing through AND circuit 87, thence setting start latch 88. Start latch 88 being set causes the document reproduction machine 10 to initiate a single-image run. The AND circuit 87 is further responsive to certain error conditions being absent for setting start latch 88. Additionally, a timing pulse (not shown) from other control circuits 53 may time the setting of start latch 88 in a synchronous manner. The error circuits, which are a condition precedent to setting start or run latch 88, include paper jam circuits 90 not indicating a jam and other error detectors (not shown). OR circuit 91 combines all of the error-indicating signals for resetting start latch 88 for stopping document reproduction machine 10. NOT circuit 92 takes the output of OR circuit 91 and activates AND circuit 87 to start the machine whenever all error conditions are absent.

Start circuit 88 initiates operation of the machine via AND circuit 93. AND circuit 93 is jointly responsive to the start latch 88, plus other conditions (not shown), and a timing pulse received over line 94 from other control circuits 53 for actuating copy path circuits 76. Copy path circuits 76, in turn, actuate the mechanism of document reproduction portion 13 in a known manner for transferring copies from interim storage unit 40 through the paper paths 27, 29. It will be remembered that at this time side latch 64 is set to the side-2 indicating condition, with the active signal on line 74 moving gate 42 to the downward position, as well as actuating circuits (not shown) for removing the copies from interim storage unit 40 through path 44, thence to path 27. Such latter operations are in known machines and are not described for that reason.

Further, empty interim latch 84 active signal on line 85 travels to OR circuit 95 for lighting standby lamp 96 in control panel 52. OR circuit 95 receives inputs over line 97 from other control circuits 53 for also lighting standby lamp 96 during other operating conditions in which copies are not to be made in machine 10. Lamp 96 being lit indicates to the operator that the document reproduction machine 10 is not available for selection or for copy production. In this manner, the emptying of storage unit 40 interrupts the normal day-to-day copy production until all the copies in unit 40 have been transferred as above described. The transfer is complete when switch 41 senses no more copies in interim storage unit 40. At this time, the signal on line 45 resets side latch 64 to the active condition after copy path circuits 76 indicate the copy path is clear. Also, copy path circuits 76 supply the copy path clear signal to AND circuit 98 of control circuits 51. AND circuit 98 responds to this signal, plus a stop latch 100 being set to the active condition (as will be later described) to supply a resetting pulse through OR circuit 101 for resetting empty interim latch 84. This action removes the activating signal from AND circuit 87, as well as extinguishing the standby lamp 96. The start latch 88 is then reset to the inactive condition by AND circuit 102 jointly responding to empty interim latch 84 being set, the line 45 signal being active, and the line 77 signal being active. Since latch 84 is reset long before start latch 88, delay circuit 102A maintains an active signal for AND 102. Delay 102A may be a latch set with latch 84 and reset when start latch 88 is reset. The start latch 88 being reset removes activating signals flowing from start latch 88 to other control circuits 53 as indicated by arrow 103. The document reproduction machine now may be used in normal day-to-day operations. Of course, the operator must remove the copies from the output copy handler in the event of the document reproduction machine having manual control of that portion.

Stop latch 100 is set to the active condition by stop button 104 actuating pulse former 105. Other inputs to the stop latch 100 (not shown) include activating signals from the paper jam circuits and the like. Stop latch 100 is reset by AND circuit 106 responding to timing signals from other control circuits 53, and to the line 77 signal from copy path circuits 76 indicating the copy path is clear (copy path includes the document reproduction portion and the output portion — collator). The latch 100 signal also flows over line 110 to other control circuits 53 for utilization in controlling various portions of the document reproduction machine not pertinent to the present invention.

In the event document reproduction machine 10 is in a noncollate mode, i.e., a collator (not shown) in output copy handler 14 is not being used, and a single bin receives all the copies, it can occur that the number of copies produced exceeds the handling capacity of the bin (not shown) in the output copy handler. Accordingly, to avoid paper jam problems, when the bin becomes full the transfer from interim storage unit 40 to the output copy handler must be interrupted. An output bin (not shown) has a scale for weighing the copies in the output bin. This scale can consist of the copy bin being pivoted at on end and being spring urged upwardly at the opposite end. At the spring-urged end, a switch 112 is urged from a normally closed (NC) position to a open position. This contact opening signifies that the output bin is full. Switch 112 has one contact connected to a $-V$ supply and a second contact at 113 connected through a resistor 114 to a $+V$ supply. When the contacts are closed, the contact 113 is at a relatively negative potential, thereby providing no actuating signal through OR circuit 91. However, upon the opening of the NC contacts 112, a relatively positive signal flows through OR circuit 91, thence OR circuit 115 resetting start latch 88. As previously described, resetting start latch 88 interrupts the document reproduction machine such that no more blank paper is provided from the interim storage unit 40 to the paper paths 27 and 29. Upon removal of the copies from the bin, switch 112 contacts again close, removing the resetting signal from start latch 88. NOT circuit 92 and the output signal from OR circuit 86 again actuate AND circuit 87 setting start latch 88. The transfer from interim storage unit 40 through the paper path 27, 29, through the aligner 37, and through the output copy handler 14 automatically restarts. This action, of course, can be repeated several times depending on the relative capacities of the interim storage unit 40 and the output copy handler 14. Since switch 41 indicates there are still copies in interim storage unit 40, line 45 signal continues to indicate copies in the storage unit, thereby inhibiting resetting the previously described circuits 51, keeping standby lamp 96 illuminated. In case of a paper jam, paper jam circuits 90 supply an activating signal for illuminating clear paper path lamp 120. In such a situation, the paper jam circuits 90 also reset start latch 88 causing interruption of the transfer of copies from interim storage unit 40 to output copy handler 14. Clearing the jam and re-establishing the machine in normal operating condition automatically restarts the transfer of copies from unit 40 to handler 14. As later described, recovery from a paper jam results in an intermediate machine state used in connection with the present invention.

The transfer of the last copy set through paths 27, 29 exposes all of the single image duplex copies to transfer station 26. Accordingly, action should be taken to prevent inadvertent transfer of images from photoconductor member 20 to the copies being transferred. To this end, the copy reproducing process is inhibited while transferring the last copy set to handler 14 from unit 40. This inhibition is achieved in circuits 51. AND circuit 122 responds to the empty interim latch 84 being reset (the last copy set is not being transferred), and a copy path circuit 76 signal on line 123 indicating that the copy path is expecting to receive copies to be made or copies are in the path to supply an activating signal over line 124 to other control circuits 53. This line 124 activating signal actuates other control circuits 53 to drive a machine billing meter M and synchronously turn off the interimage erase lamp 30E with respect to photoconductor member 20 rotation. During the empty interim storage no-image run, these functions are inhibited such that interimage erase lamp 30E is on, continuously erasing the photoconductor member 20 ensuring that the surface of the member 20 is completely discharged. Hence, no toner laden beads adhere to the photoconductor surface keeping the back sides of the last copy set clean. Additionally, charging station 21 and developer station 24 may be deactivated during the empty interim storage no-image cycle. Such paper transport can be treated as an active copy run or as an intermediate state as hereinafter described.

Manually actuated keyboard 130 of document reproduction machine 10 selects the number of copies to be produced in a copy job. Keyboard 130 is mounted in a console 131. In addition to keyboard 130, the console includes operator station control panel 52 display and selection switches, as well as a time out timer 132 which, in accordance with the invention, reselects certain operator selections if the document reproduction machine 10 has not been used for a predetermined time. Such predetermined time will vary upon selection parameters of the document reproduction machine. In one machine 10, timer 132 had a time-out of 30 seconds; in another, 90 seconds. Time-out timer 132 is reset and inhibited by a signal traveling over line 134 from control panel 52. Time-out timer 132 actuation is later described. When time-out timer 132 has timed out, it supplies an actuating signal over line 135 for reselecting the operator selections to the dominant mode.

Figure 3:
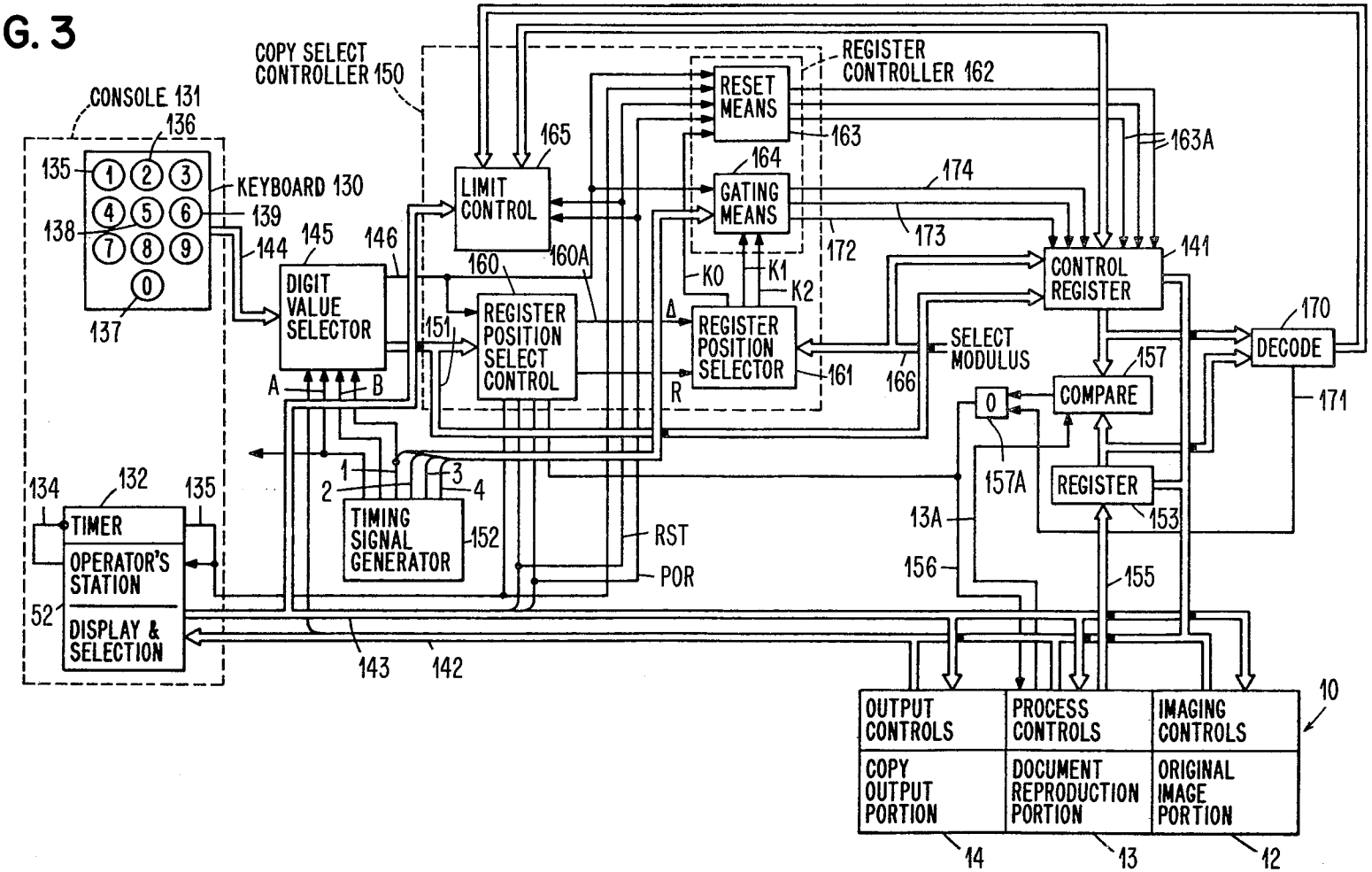
FIG. 3 is a second diagrammatic partial showing of the FIG. 1 illustrated machine emphasizing copy count circuits and operators console.

Keyboard 130 can be of any design. However, it is preferred that the keying arrangement be as shown in FIG. 3. The numeral 1 is selected by the left-hand button 135, number 2 by button 136, etc., through button 137 which selects zero. An operator selects the number of copies to be produced by a succession of key depressions. For example, if 156 copies are to be produced, the operator first depresses key 135 (selects 1), then the 5-indicating key 138 and then the 6-indicating key 139. The number 156 is then automatically inserted into control register 141 and suitably displayed in panel 52 by signals supplied over cable 142 from control register 141. Such signals from control register 141 are also applied to the controls of machine 10. Additionally, panel 52 supplies selection control signals over cable 143 to the control circuits described herein.

Keyboard 130 key closure signals travel over cable 144 (ten circuits, one for each key) actuating digit value selector circuit 145 to detect the value of the key depressed, as well as integrating the closures and openings for eliminating noise and bounce caused noise signals. Selector 145 supplies a digit received signal over line 146 to actuate copy select controller 150 to insert a new data value into control register 141. The data values are supplied in binary coded decimal, or other coded form, over cable 151 to copy select controller 150 and to control register 141. Controller 150 examines the data signals on cable 151 for determining whether or not a significant value signal is being received. If no significant value signal is being received, then the data value signals are not inserted into control register 141.

Figure 4:
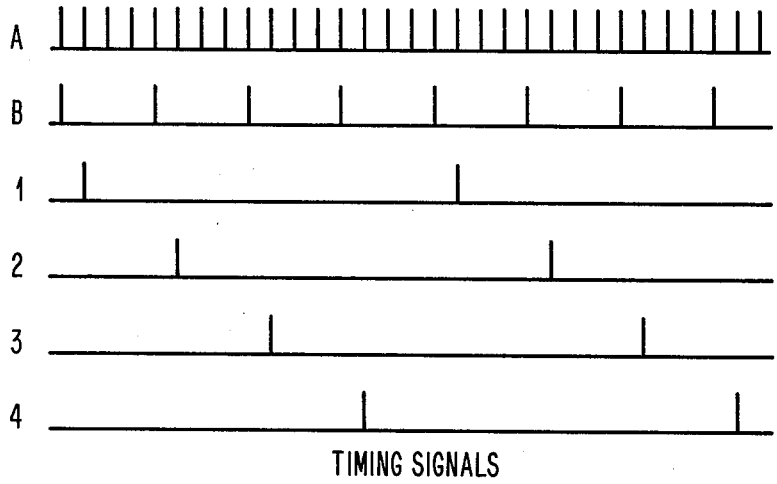
FIG. 4 is a timing diagram.

A timing signal generator 152 synchronizes the operation of a portion of the illustrated electronic circuits. Generator 152 provides a high-frequency signal A (see FIG. 4), a submultiple frequency B, and a set of four distributor pulses 1–4 for sequencing copy select controller 150.

Control register 141 signal content signifies the number of copies to be made in a copy set, i.e., how many times the original image is to be reproduced in a set of copies in a given copy run. A second register or copy counter 153 receives signals over cable 155 from document reproduction portion 13 signifying the number of copies actually produced in a given set of copies. When the signal contents of register 153 equals the signal contents of register 141, the copy set is complete and the document reproduction machine is turned off by a last copy signal supplied over line 156. To this end, compare circuit 157 responds to signals from control register 141 and from copy count register 153 to supply the last copy signal through OR circuit 157A, thence to line 156 for turning the document reproduction machine 10 off. The last copy signal also goes to copy select controller 150. To synchronize operation of compare 157 with the image or copy cycles of portion 13, image indicating timing signals travel over line 13A to compare 157.

Copy select controller 150 includes a register position select control 160 which detects the data signals in cable 151 for significant values and simultaneously controls register position selector 161. Register position selector 161 in turn controls register controller 162 for selectively inserting cable 151 signals into control register 141 and shift signal contents thereof to more significant digit positions. Register controller 162 includes reset means 163 which resets appropriate digit positions of register 141, as well as gating means 164 which selectively actuates control register 141 to receive the cable 151 data signals. Register position selector 161 indicates the number of significant digits in control register 141 and controls the gating means 164 and the reset means 163 to appropriately control register 141 to receive the serialized decimal digits from keyboard 130. Position select control 160 reads a digit received indicating signal over line 160A to increment a counter (not shown) in selector 161 to a reference state (register 141 can be empty) over line R. Limit control 165 limits the number of copies in a copy set by selectively altering the signal contents of control register 141 in accordance with functional capabilities of the document reproduction machine 10. That is, the modulus of register 141 is 1000. Some elements (paper bins, for example), (not shown) of machine 10 may have a capacity of 500 copies; limit control 165 limits the number of copies to 500 when such element is used in a copy run. Limit control 165 and the select modulus signals received over cable 166 provide additional controls on automatically limiting the number of copies in a given copy set in accordance with selections beyond the control of the operator.

Reset means 163 receives the console 131 generated reset signals POR, RST (reset switch closed) as well as the timer 132 signal on line 135 to reset register 141 to a reference state (*0*). Reset means 163 has one reset line 163A for each of the register 141 digit positions.

Decode circuit 170 examines the signal contents of control register 141 and register 153 for illegal signal patterns and for detecting when the signal contents of register 153 has a numerical value greater than the numerical value contained in control register 141. In the latter case, a stop signal is supplied over line 171 through OR circuit 157 to turn off the document reproduction machine 10. Additionally, an alarm may be sounded, or a suitable indicator (not shown) is illuminated within panel 52. Decode 170 also supplies control register 141 decoded signals to limit control 165 for indicating the magnitude of the value signals in register 141. Limit control 165 responds to such decoded signals for determining whether or not the signal contents of register 141 should be altered to coincide with the functional capabilities of document reproduction machine 10.

Gating means 164 responds to the K1, K2 counter states of register position selector 161 counter (not shown), to achieve the shifting the data insertion into control register 141. Control register 141 is a decimal shift register having the units, tens, and one hundreds digit positions. It is preferred that register 141 contain signals in the binary coded decimal notation, no limitation thereto intended. Cable 151 is connected to the unit digit position which consists of four D-type flip-flops (not shown). The data signals on cable 151 are supplied to the data input (D) of the respective D-type latches (not shown) while the gating means 164 control signals are connected to the clock inputs (not shown).

The sequence of inserting signals into register 141 is achieved by the distributor pulses 1–4. Distributor pulse 1 detects receipt of a digit value by digit value selector 145. The circuits 164 are then conditioned for detecting the action required for inserting the received value signals or for inhibiting the received value signals by the line 146 signal. In the event signals reside in the units and tens digit positions of register 141, the 2 distributor pulse plus the K2 indicating state of selector 161, as well as the line 146 active signal, shift the signal contents of the register 141 tens digit position to the register 141 hundreds digit position; all of the above indicated by line 172. Such shifting is achieved by circuitry (not shown) contained within register 141 as is well known in the arts. Then, at distributor time 3, the gating means 164 responds to the K1 and K2 states to shift the signal contents of the register 141 units digit position (not shown) to the tens digit position (not shown), all of the above indicated by line 173. This action is identical to the shift from the tens to the hundreds digit position. Finally, the 4 distributor pulse and gating means 164 pulse activate the C inputs of the D latches (not shown) in the register 141 units digit position, all as indicated by line 174.

Reset means 163 cooperates with selector 161 and the other previously indicated reset control signals for resetting and conditioning control register 141 to reflect the desired number of copies to be produced.

Figure 5:
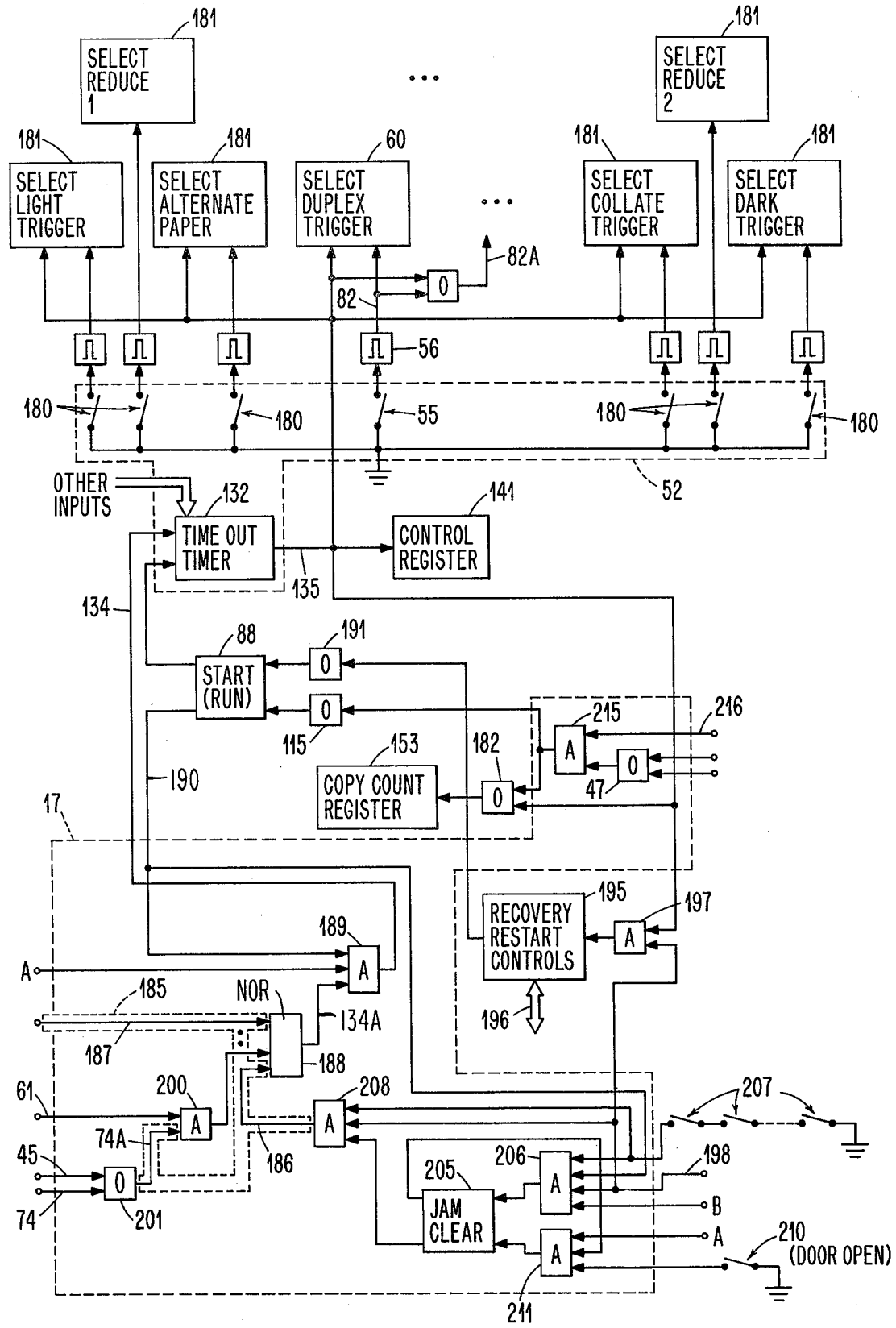
FIG. 5 is a schematic showing of a preferred embodiment of the invention as installed in the FIG. 1 illustrated invention.

Referring now more particularly to FIG. 5, automatic reselection is described. Controls 60, 181, etc., are actuated by circuits from control panel 52 which include a plurality of manually actuated switches 55 and 180. Closure of the switch 55, 180 actuate a corresponding pulse former such as pulse former 56 for emitting a trigger switching pulse to alternate the signal state of the respective mode selection triggers 60 and 181. Accordingly, two closures of the switches 180 successively select a mode and deselect such mode. Additionally, time-out timer 132 emits its time-out reselection pulse over line 135, resetting all of the triggers 60 and 181 to the dominant mode indicating state. For the illustrated embodiment, the dominant mode corresponds to the reset state of the mode selection latches 60, 181. Additionally, time-out timer 132 resets control register 141 to its reference state for producing a single copy from a single original and resets copy count register 153 to the zero state via OR circuit 182.

Dominant mode reselect control 17 actuates time-out timer 132 by an appropriate enabling signal over line 134. During normal operations, line 134 carries an inhibit signal preventing time-out timer 132 from issuing any pulses or from timing any predetermined period. In this regard, time-out timer 132 may be a monostable multivibrator or an oscillator driven counter for measuring elapsed time.

Intermediate machine state indicating lines 185 include line 74A for indicating an intermediate state in the duplex copy mode, plus line 186 connected to line 198 and indicating an intermediate state in a jam error recovery procedure. Additionally, machine 10 may include other intermediate state indicating lines 187. All of the lines 185 supply signals via NOR circuit 188 to partially enable AND circuit 189. Any one of the lines 185, including lines 187, 186, having a positive signal for indicating an intermediate state disables AND 189, hence inhibits timer 132. When all lines are negative, no intermediate state is acitve, AND 189 is enabled to start timer 132 as described. AND circuit 189 also receives a NOT RUN or NOT START signal from latch 88 via line 190, plus an A timing pulse from timing signal generator 152 of FIG. 3. AND circuit 189 then emits a timer actuating pulse over line 134 to initiate time-out timer 132. During run (latch 88 set) and during an intermediate state no pulses are sent over line 134, rather a negative signal inhibits timer 132.

Timer 132 can be stopped by latch 88 being set to the active condition. Latch 88 may be set via OR circuit 191 which is electrically interposed between AND 87 and latch 88 of FIG. 2. Recovery restart controls 195 selectively set start latch 88 via OR circuit 191 after a jam condition or other interrupted stoppage of the document reproduction machine 10. Cable 196 indicates connections to other portions of the machine with regard to such automatic restarting. The functions of recovery restart controls 195 include resetting restart controls 195 upon a time-out of timer 132. Such resetting action is important to prevent an inadvertent restarting of machine 10 after the timer 132 has indicated the dominant mode has been reselected. To reset restart controls 195, AND circuit 197 passes the line 135 pulse after a jam as indicated by signal on line 198 from paper jam circuits 90. The line 198 signal is maintained until a predetermined time after start latch 88 has been set to the active condition. Such memory is important to maintaining appropriate interactions during the error recovery procedures.

Additionally, timer 132 may be reset and inhibited from timing out by various other machine states. Such states include Not Ready, Diagnostic Mode, Power On Reset, Copy Cycle, etc.

Figure 2:
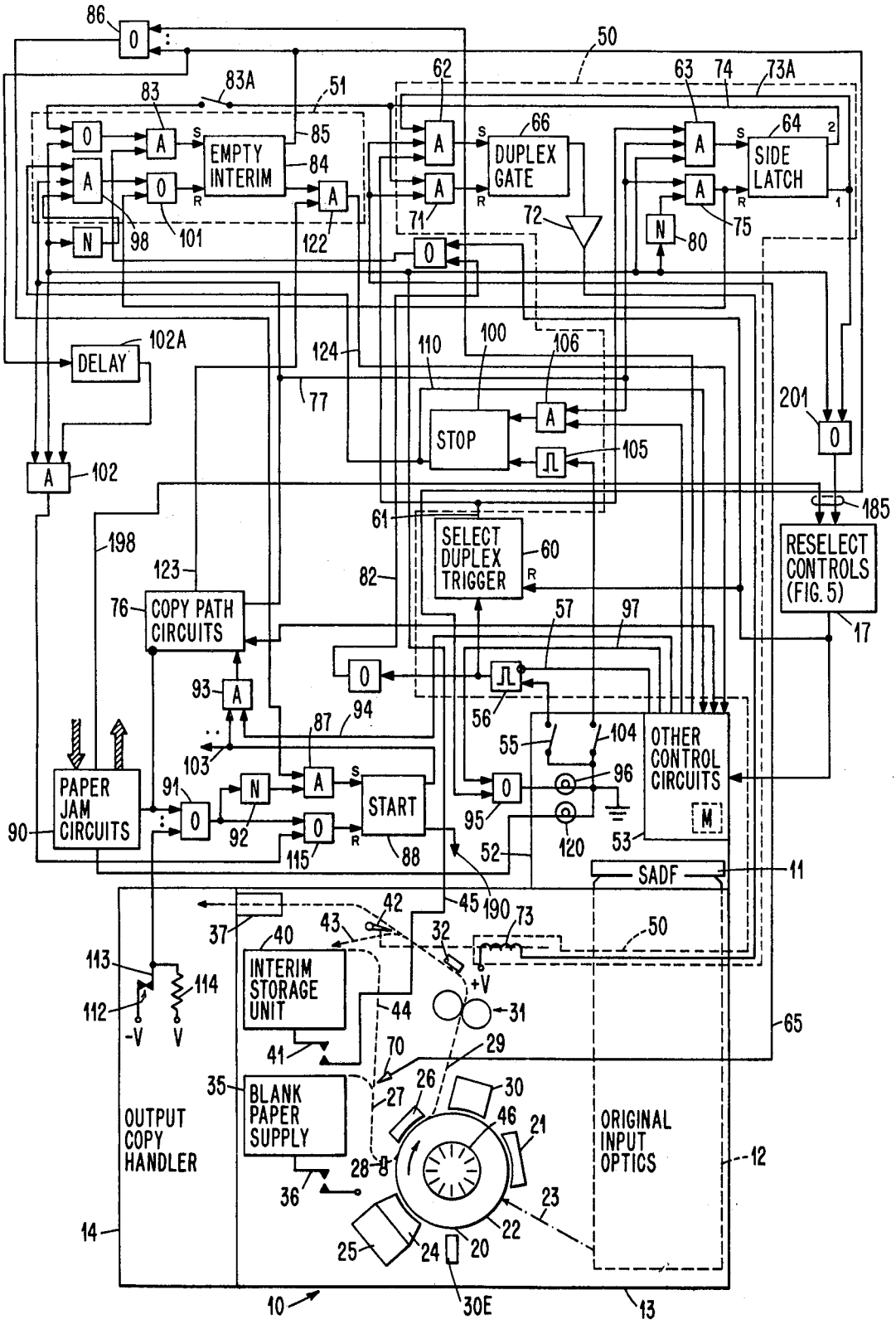
FIG. 2 is a diagrammatic showing of the FIG. 1 illustrated machine with a showing of some control circuits with respect to duplex copy production.

The intermediate state generation for the duplex mode includes AND circuit 200 responding to the duplex indicating signal on line 61 to pass either the line 74 signal or the line 45 signal received via OR circuit 201. The line 45 signal signifies paper is in interim storage unit 40 as sensed by switch 41 (FIG. 2). In a practical embodiment of the invention, it is preferred that switch 41 supply the line 74 signal.

A second intermediate state indicated by the signal on line 186, as derived from the intermediate signal generating line 198, includes a jam clear latch 205, signifying that the paper jam is clear but that further operator action is required before document reproduction machine 10 can be started. Jam clear latch 205 operates with respect to paper jams in any portion of the machine. Jam clear latch 205 normally is in the reset state. AND circuit 206 responds to the line 198 signal, a B type timing pulse, start latch 88 being reset as indicated on line 190, and the paper path switches 207 all being closed indicating absence of paper in the paper path (not shown) to supply a latch setting signal setting jam clear latch 205 to the active condition. When latch 205 is in the active condition, AND circuit 206 is disabled such that the jam signal is not passed. Further, the jam switches 207 are required, to be closed to enable AND circuit 208.

The intermediate state is removed by switch 210 closing to indicate that the access door to the paper jam area has been closed preparatory to restarting after a jam was detected. AND circuit 211 is enabled by the switch 210 closing and jam clear latch 205 being in the active state to pass an A timing pulse resetting jam clear latch 205. This action when switches 207 are closed and a jam condition has been memorized, passing an enabling signal from jam clear latch 205 through AND 208, thence, OR 188 to enable AND circuit 189.

The above action indicates the character of intermediate states usable with document reproduction machine 10 for achieving the goals of the present invention. It is clear that other forms of intermediate states can be used with equal effectiveness for disabling reselection controls.

Copy count register 153 can be reset at start time independent of reselection control 17. To this end, AND circuit 215 receives a plurality of signals as indicated by lines 216 and OR circuit 47 for setting start latch to the active condition via OR circuit 115 as well as clearing copy count register 153. Both modes of resetting copy count register 153 may be employed in the same machine.

Dominant mode characteristics are a function of copy production goals. For example, when a document reproduction machine has a plurality of image inputs, such as a platen plus an automatic laser type image generator, the dominant mode may use the laser input to the exclusion of the platen input. When the platen is to be used, the laser input is overridden. Then upon completion of the platen input job, the time-out reselects the dominant input — the laser image generator. In such a machine, a fully automatic input mode is a dominant mode. Other diverse characteristics can be equally included in a dominant copy production mode.

While the invention has been particularly shown and described with reference to preferred embodiments thereof, it will be understood by those skilled in the art that various changes in form and details may be made therein without departing from the spirit and scope of the invention.

What is claimed is:

1. A document reproduction machine operable in a succession of copy runs for performing copy jobs wherein certain copy jobs include multi-runs, a control element for initiating a copy run, one run at a time, and imposing one of a plurality of copy modes on said machine, including a dominant copy mode; control means indicating given machine states within said copy modes; run means indicating no active copy run being performed in said machine, a time-out timer for timing a predetermined time-out period;

the improvement including in combination:

status means in said control means indicating a predetermined intermediate one of said given machine states;

means to terminate said predetermined intermediate state;

reselect means responsive to said time-out timer timing said predetermined time-out period to select said dominant mode;

reselect control means responsive to said run means and absence of said indicated predetermined intermediate given machine state to actuate said time-out to time said predetermined period including automatic actuation of said time-out timer upon termination of said one intermediate machine state indication while said run means indicates no active copy run; and start means in said run means to stop said timer from timing.

2. The machine set forth in claim 1 wherein said one copy mode enables a plurality of one mode copy runs to produce one set of copies;

interim storage means for holding partially produced copies intermediate ones of said one mode copy runs;

intermediate means indicating copies in said interim storage means; and said status means being responsive to said intermediate means to indicate said predetermined intermediate machine state.

3. The machine set forth in claim 2 wherein said one copy mode is a duplex copy mode and further including means actuating said control element to remove said duplex copy mode, means responsive to said removal of said duplex copy mode with said partially produced copies remaining in said interim storage means to automatically remove said partially produced copies from said interim storage means for automatically removing said intermediate state.

4. The machine set forth in claim 2, the improvement further including in combination:

first means in said control element indicating end of duplex copy production job; and duplex job terminating means being responsive to said first indicating means to transport said partially produced copies from said interim storage means to said output portion and including means inhibiting said time-out timer while emptying said interim storage means.

5. The machine set forth in claim 4 wherein said intermediate means includes sensing means for sensing presence of one or more copies in said interim storage means.

6. The machine set forth in claim 4 wherein said intermediate means further includes side indicating means for indicating first and second image one mode copy run production; and means supplying said second image copy indication to said duplex run terminating means for enabling said transport of said single-image partially produced duplex copies from said interim storage means.

7. The machine set forth in claim 1 having jam recovery means;

jam clear means in said recovery means indicating a jam state or a recovered machine state; and said status means responsive to said jam clear means jam state indication to indicate said predetermined intermediate machine state.

8. The machine set forth in claim 7 further including:

preparatory means for preparing said machine for copy production and operative to reset said jam clear means for indicating said jam state whereby said predetermined intermediate state ceases to enable starting said time-out timer.

9. The machine set forth in claim 1 further having a jam recovery restart circuit;

the improvement further including:

means responsive to said time-out timer to reset said restart circuit.

10. A document reproduction machine operable in a succession of independent copy runs including multi-run copy jobs, a control element for initiating a copy run and imposing at least one of a plurality of copy modes on said machine, including a dominant copy mode;

mode control means indicating a multi-run copy job copy mode;

error control means indicating one of a plurality of error conditions in said machine;

runs means indicating no active copy run being performed in said machine;

a time-out timer for timing a predetermined time-out period;

the improvement including in combination:

intermediate means in each of said control means indicating an intermediate machine status with respect to said one control means;

means to reset said intermediate means to indicate absence of an intermediate state;

reselect control means jointly responsive to said run means indicating no active copy run and to said intermediate means not indicating said intermediate machine state to actuate said time-out timer to time said predetermined time-out period including actuating said time-out timer upon reset of said intermediate state while said run means indicates no active copy run; and reselect means responsive to said time-out timer completing timing said predetermined time-out period to force selection in said machine to said dominant mode.

11. The machine set forth in claim 10, the improvement further including in combination:

run status means in said intermediate means indicating a predetermined intermediate state of a multi-run copy job;

recovery status means in said intermediate means indicating a predetermined error status intermediate state in recovery from a given error condition; and means combining said multi-run and said error status intermediate state indications as said intermediate machine state.

12. The machine set forth in claim 11 further including in combination:

job control means in said control element actuating said run status means to end a copy job; and end of multi-run job means responsive to said job control means and to said multi-run intermediate state to further inhibit said time-out timer.

13. The machine set forth in claim 12 including;

means in said job control means resetting said multi-run intermediate state and means in said end of multi-run job means to memorize said multi-run intermediate state;

interim means storing partially produced copies; and empty means responsive to said memorized multi-run intermediate state to automatically remove said partially produced copies from said interim means.

14. The machine set forth in claim 10 having automatic restart means for restarting said machine from a point of error, further including in combination:

restart preparatory means resetting said error control means to remove said one error state indication; and said time-out timer connected to said restart means for resetting same to a non-start state.

15. A method of operating a document reproduction machine operable in a succession of independent copy runs, the steps of:

selecting an operational copy mode in said machine;

measuring elapsed time of non-use of said machine up to a predetermined time;

indicating an intermediate state of the machine during said non-use;

inhibiting said measuring during said intermediate state indication;

removing said intermediate state indication for enabling said measuring elapsed time beginning from said removal of said intermediate state indication; and automatically selecting a dominant operational copy mode upon expiration of said measured predetermined time.

16. The method set forth in claim 15 further including the steps of:

after removing said intermediate state indication but before selecting said dominant copy mode, executing an intermediate copy transport function in said machine; and inhibiting said measuring while executing said intermediate function.

17. The method set forth in claim 15 further including the steps of:

detecting a machine error;

correcting a machine error;

indicating said intermediate state after correcting said machine error; and preparing the machine for copy production.

18. The method set forth in claim 15 wherein one of said copy modes requires a multi-run copy job, further including the steps of;

storing partially produced copies within said machine for said multi-run copy job; and inhibiting said measuring until said job is complete irrespective of non-use between successive ones of said runs within said job.

* * * * *